US009663894B2

(12) United States Patent
Kim et al.

(10) Patent No.: US 9,663,894 B2
(45) Date of Patent: May 30, 2017

(54) STEAM GENERATOR AND LAUNDRY DRYER HAVING THE SAME AND CONTROLLING METHOD THEREOF

(75) Inventors: Young Soo Kim, Changwon-si (KR); Dae Bong Yang, Jinhae-si (KR); Chul Jin Choi, Changwon-si (KR); Jung Yoo, Busan (KR); Jae Hyuk Wi, Busan (KR)

(73) Assignee: LG Electronics Inc., Seoul (KR)

( * ) Notice: Subject to any disclaimer, the term of this patent is extended or adjusted under 35 U.S.C. 154(b) by 1383 days.

(21) Appl. No.: 12/084,694

(22) PCT Filed: Nov. 8, 2006

(86) PCT No.: PCT/KR2006/004663

§ 371 (c)(1),
(2), (4) Date: Dec. 22, 2009

(87) PCT Pub. No.: WO2007/055510

PCT Pub. Date: May 18, 2007

(65) Prior Publication Data

US 2010/0115788 A1 May 13, 2010

(30) Foreign Application Priority Data

Nov. 10, 2005 (KR) ..... 10-2005-0107661
Nov. 30, 2005 (KR) ..... 10-2005-0115387

(51) Int. Cl.
*F26B 11/02* (2006.01)
*F26B 3/00* (2006.01)
(Continued)

(52) U.S. Cl.
CPC ..... *D06F 58/26* (2013.01); *D06F 58/203* (2013.01)

(58) Field of Classification Search
CPC .... D06F 5/04; F26B 21/06; F26B 3/02; F26B 19/00
(Continued)

(56) References Cited

U.S. PATENT DOCUMENTS 2,694,867 A * 11/1954 Smith ..... 34/605
3,878,991 A * 4/1975 Sabadics et al. ..... 239/456
(Continued)

FOREIGN PATENT DOCUMENTS

CN 2492229 5/2002
DE 3408136 A1 9/1985
(Continued)

*Primary Examiner* — Kenneth Rinehart
*Assistant Examiner* — John McCormack
(74) *Attorney, Agent, or Firm* — Dentons US LLP

(57) ABSTRACT

A water supply device for a drying machine and a method for controlling the same are disclosed. The water supply device includes a common hose having one end connected to at least one water supply source, a drying machine water supply hose having one end connected to the common hose and the other end connected to a steam generator of the drying machine, and a washing machine water supply hose having one end connected to the common hose and the other end connected to a washing machine. With the provision of the water supply device, the drying machine has the effects of preventing wrinkles, creases, or the like from being generated in an object to be dried, such as clothes, and the like, or eliminating wrinkles, creases, or the like in clothes, and the like.

18 Claims, 5 Drawing Sheets

(51) Int. Cl.
*D06F 58/26* (2006.01)
*D06F 58/20* (2006.01)

(58) Field of Classification Search
USPC ... 34/443, 607, 130, 60, 461, 122, 487, 492, 34/507, 413, 552, 218, 241; 68/15; 8/149; 239/8, 110, 106, 120, 468
See application file for complete search history.

(56) References Cited

U.S. PATENT DOCUMENTS

| | | | | |
|---|---|---|---|---|
| 3,990,639 | A * | 11/1976 | Laauwe | 239/492 |
| 4,207,683 | A * | 6/1980 | Horton | 34/60 |
| 4,578,878 | A * | 4/1986 | Mizuta et al. | 34/541 |
| 4,665,628 | A * | 5/1987 | Clawson | 34/449 |
| 5,020,469 | A * | 6/1991 | Boissevain et al. | 118/67 |
| 5,065,673 | A * | 11/1991 | Taylor et al. | 100/40 |
| 5,143,295 | A * | 9/1992 | Okayama et al. | 239/403 |
| 5,193,995 | A * | 3/1993 | Keller et al. | 431/351 |
| 5,219,371 | A * | 6/1993 | Shim et al. | 8/149.1 |
| 5,460,041 | A * | 10/1995 | Andes et al. | 73/335.08 |
| 5,642,579 | A * | 7/1997 | Netten et al. | 38/77.7 |
| 5,768,730 | A * | 6/1998 | Matsumoto et al. | 8/159 |
| 6,089,024 | A * | 7/2000 | Hatanaka | 60/671 |
| 6,189,346 | B1 * | 2/2001 | Chen et al. | 68/5 R |
| 6,595,163 | B2 * | 7/2003 | Dumaz | F04F 5/461 122/404 |
| 6,863,475 | B2 * | 3/2005 | DeVaull et al. | 405/269 |
| 7,325,330 | B2 * | 2/2008 | Kim et al. | 34/407 |
| 7,347,009 | B2 * | 3/2008 | Ahn et al. | 34/607 |
| 7,404,304 | B2 * | 7/2008 | Yang et al. | 68/5 C |
| 7,600,402 | B2 * | 10/2009 | Shin et al. | 68/5 C |
| 7,681,328 | B2 * | 3/2010 | DuVal et al. | 34/597 |
| 7,814,770 | B2 * | 10/2010 | Jeon et al. | 68/13 R |
| 7,841,219 | B2 * | 11/2010 | Wong et al. | 68/15 |
| 7,913,339 | B2 * | 3/2011 | Wong et al. | 8/149.3 |
| 7,913,522 | B2 * | 3/2011 | Park | 68/5 R |
| 7,930,838 | B2 * | 4/2011 | Bae et al. | 34/597 |
| 8,166,669 | B2 * | 5/2012 | Park et al. | 34/399 |
| 8,181,359 | B2 * | 5/2012 | Bae et al. | 34/604 |
| 2004/0163184 | A1 * | 8/2004 | Waldron et al. | 8/149.1 |
| 2004/0187527 | A1 * | 9/2004 | Kim et al. | 68/5 C |
| 2004/0187529 | A1 * | 9/2004 | Kim et al. | 68/207 |
| 2004/0216327 | A1 * | 11/2004 | Chung | 34/607 |
| 2005/0034248 | A1 * | 2/2005 | Oh et al. | 8/149.3 |
| 2005/0034250 | A1 * | 2/2005 | Oh et al. | 8/159 |
| 2005/0034487 | A1 * | 2/2005 | Oh et al. | 68/5 C |
| 2005/0034488 | A1 * | 2/2005 | Oh et al. | 68/5 C |
| 2005/0144735 | A1 * | 7/2005 | Yang et al. | 8/149.3 |
| 2006/0016092 | A1 * | 1/2006 | Kim et al. | 34/130 |
| 2006/0101586 | A1 * | 5/2006 | Park et al. | 8/149 |
| 2006/0101588 | A1 * | 5/2006 | Park et al. | 8/158 |
| 2006/0213092 | A1 * | 9/2006 | Di Leta | 38/77.1 |
| 2007/0006484 | A1 * | 1/2007 | Moschuetz et al. | 34/597 |
| 2007/0210186 | A1 * | 9/2007 | Fenton | A62C 5/002 239/422 |
| 2008/0196267 | A1 * | 8/2008 | Park et al. | 34/443 |
| 2008/0256720 | A1 * | 10/2008 | Park et al. | 8/149.3 |
| 2009/0139277 | A1 * | 6/2009 | Park et al. | 68/5 C |
| 2009/0151400 | A1 * | 6/2009 | Park | 68/5 C |
| 2009/0211109 | A1 * | 8/2009 | Choi et al. | 34/491 |
| 2010/0058610 | A1 * | 3/2010 | Kim et al. | 34/474 |
| 2012/0006300 | A1 * | 1/2012 | Akabane | 123/470 |

FOREIGN PATENT DOCUMENTS

| | | | |
|---|---|---|---|
| DE | 10260151 | A1 | 7/2004 |
| EP | 1275767 | A1 | 1/2003 |
| EP | 1 555 338 | | 7/2005 |
| EP | 1550760 | A2 | 7/2005 |
| EP | 1555340 | A2 | 7/2005 |
| EP | 1 600 545 | | 11/2005 |
| EP | 1657342 | A1 | 5/2006 |
| JP | 2002-346295 | | 12/2002 |
| KR | 10-2003-0061190 | | 7/2003 |
| KR | 10-2004-0015523 | | 2/2004 |
| KR | 10-2004-0063394 | | 7/2004 |
| KR | 10-2005-0017488 | | 2/2005 |

* cited by examiner

STEAM GENERATOR AND LAUNDRY DRYER HAVING THE SAME AND CONTROLLING METHOD THEREOF

TECHNICAL FIELD

This application is a national stage entry under 35 U.S.C §371 of International Application No. PCT/KR2006/004663, filed on Nov. 8, 2006, and claims priority to Korean Patent Application No. 10-2005-0107661, filed on Nov. 10, 2005 and Korean Patent Application No. 10-2005-0115387 filed on Nov. 30, 2005, all of which are incorporated by reference, as if fully set forth herein, in their entireties.

The present invention relates to a laundry dryer, and more particularly to a laundry dryer having a steam generator which can effectively remove or prevent wrinkles or creases of objects to be dried like clothes.

BACKGROUND ART

Typically, laundry dryers are home appliances for removing the remaining moisture in objects to be dried like laundry by using air of high temperature. Laundry dryers generally comprise a drum for containing objects to be dried, a driving device for driving the drum, a heating device for heating air flowing into the drum, and a blower unit for sucking air in the drum or discharging the same.

Laundry dryers are classified into an electric-type dryer and a gas-type dryer according to air heating methods, i.e., heating devices. The electric-type dryer heats air by using electric resistance heat, and the gas-type dryer heats air by using heat generated by gas combustion. Laundry dryers may also be classified into a condenser-type dryer and an exhaust-type dryer. In the condenser-type dryer, the air circulating in the dryer absorbs moisture from objects to be dried contained in a drum and then passes through a condenser to exchange heat with external air at the condenser. The moisture contained in the air is condensed, and the condensed water is discharged outside. In the exhaust-type dryer, high-moisture air absorbing moisture from objects to be dried contained in a drum is exhausted cut of the dryer. Laundry dryers may also be classified into a top loading dryer and a front loading dryer according to methods of throwing objects to be dried into the dryer. In the top loading dryer, the objects to be dried are thrown into the dryer through a top opening. In the front loading dryer, the objects to be dried are thrown into the dryer through a front opening.

However, the conventional laundry dryer described above has the following problems.

Generally, the dehydrated laundry after water wash is thrown into the dryer to be dried. Because of the operational features of the water wash, the laundry crumples when the water wash is completed. The creases are not removed when drying the laundry in the dryer. Therefore, in order to remove the creases of the objects like the laundry which are dried alt in the conventional dryer, a user has a trouble of ironing the laundry.

Also, while the clothes are in the custody or when a person puts on the clothes in daily life, wrinkles, creases and folds (which will be commonly called "creases") are generated at the clothes. Accordingly, the development of an apparatus capable of conveniently removing the creases, which are generated by the daily wearing or custody, from the clothes has been required.

DISCLOSURE OF INVENTION

Technical Problem

Accordingly, the present invention is directed to a steam generator and a laundry dryer having the same and a controlling method thereof that substantially obviate one or more problems due to limitations and disadvantages of the related art.

An object of the present invention devised to solve the problem lies on a laundry dryer having a steam generator which can prevent generation of creases at dried objects and remove the creases.

Another object of the present invention devised to solve the problem lies on a laundry dryer having a steam generator which can remove creases from clothes or like without using an iron.

Technical Solution

The object of the present invention can be achieved by providing a laundry dryer comprising: a drum which contains objects to be dried, the drum having an opening through which hot air flows into the drum; and a steam generator which includes a steam generating part which makes steam and a steam supply part which is connected to the steam generating part and supplies the steam into the drum.

The steam supply part includes front ends which are respectively positioned at a front end and a rear end of the drum.

At least one of the front ends of the steam supply part is positioned at an upper portion of the drum. The front ends of the steam supply part are positioned at a middle of the drum.

Preferably, the front ends of the steam supply part are disposed to be directed toward a center of the drum.

Also, the steam generating part is positioned at the front end of the drum, the front ends of the steam supply part are positioned at a middle of the drum, and the steam generating part is positioned at a side surface of the drum.

Alternatively, the front ends of the steam supply part may be positioned adjacently to the opening of the drum.

The front ends of the steam supply part are directed toward the opening of the drum.

Preferably, the front ends of the steam supply part are disposed to be directed toward the center of the drum.

Also, the opening is slantedly formed toward the center of the drum.

The steam generating part is positioned at an upper portion of the drum, and at a side surface of the drum.

The front ends of the steam supply part are respectively positioned at the front end and the rear end of the drum.

Preferably, the steam generator further includes a steam injection part which is provided at a front end of the steam supply part to inject the steam into the drum.

The steam injection part is formed in a divergent-convergent duct shape. The steam supply part is connected to a divergent portion of the steam injection part, preferably in a tangential direction.

Also, the steam supply part is connected to the steam injection part in a tangential direction, and the steam injection part is formed with a discharge hole through which condensed water is discharged.

Alternatively, the steam injection part may be formed in a conical shape. The steam injection part has a divergent portion which is formed, with a discharge hole through which condensed water is discharged. The steam injection part has an injection hole, and the discharge hole is disposed at a position lower than the injection hole.

The steam generator supplies the steam to the objects to be dried contained in the drum in a hot air non-supply state.

In another aspect of the present invention, there is provided a steam generator for a laundry dryer, comprising: a steam generating part which makes steam; a steam supply part which is connected to the steam generating part and positioned inside the drum; and a steam injection part which is provided at a front end of the steam supply part to inject the steam into the drum, the steam injection part being formed in a divergent-convergent duct shape. The steam supply part is connected to a divergent portion of the steam injection part.

The steam supply part is connected to the divergent portion of the steam injection part in a tangential direction. The divergent portion of the steam injection part is formed with a discharge hole through which condensed water is discharged.

In yet another aspect of the present invention, there is provided a method of controlling a laundry dryer, comprising: a) dampening objects to be dried so that the objects to be dried have a predetermined moisture absorption; and b) drying the objects to be dried which have absorbed moisture.

The dampening step a) includes: dampening the objects to be dried by using steam. The dampening step a) further includes: agitating the objects to be dried. The objects to be dried are agitated intermittently.

Preferably, the dampening step a) includes: dampening the objects to be dried in a hot air non-supply state. The dampening step a) further includes: exhausting steam outside intermittently.

Also, the dampening step a) includes: exhausting a certain amount of steam supplied into the drum outside. The steam is exhausted intermittently.

ADVANTAGEOUS EFFECTS

The laundry dryer having the steam generator according to the present invention structured as above has the following effects.

Firstly, the generation of creases at the dried objects can be prevented and the creases can be removed effectively. Also, the creases or the wrinkles of the clothes in the dried state can be effectively removed without ironing.

Secondly, since the front ends of the steam generator or the steam supply part are positioned at the front and rear ends of the drum and/or positioned adjacently to the opening of the drum, the condensed water is prevented from getting directly in touch with the objects to be dried, and it is possible to effectively dampen the objects to be dried. As a result, the drying and crease removal performances are increased.

Thirdly, since the vortex flow of the steam is formed in the steam injection part of the steam generator and injected into the drum, and the condensed water is discharged through the discharge hole of the steam injection part, the generation of the creases at the objects to be dried can be prevented more effectively.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Figure 1:
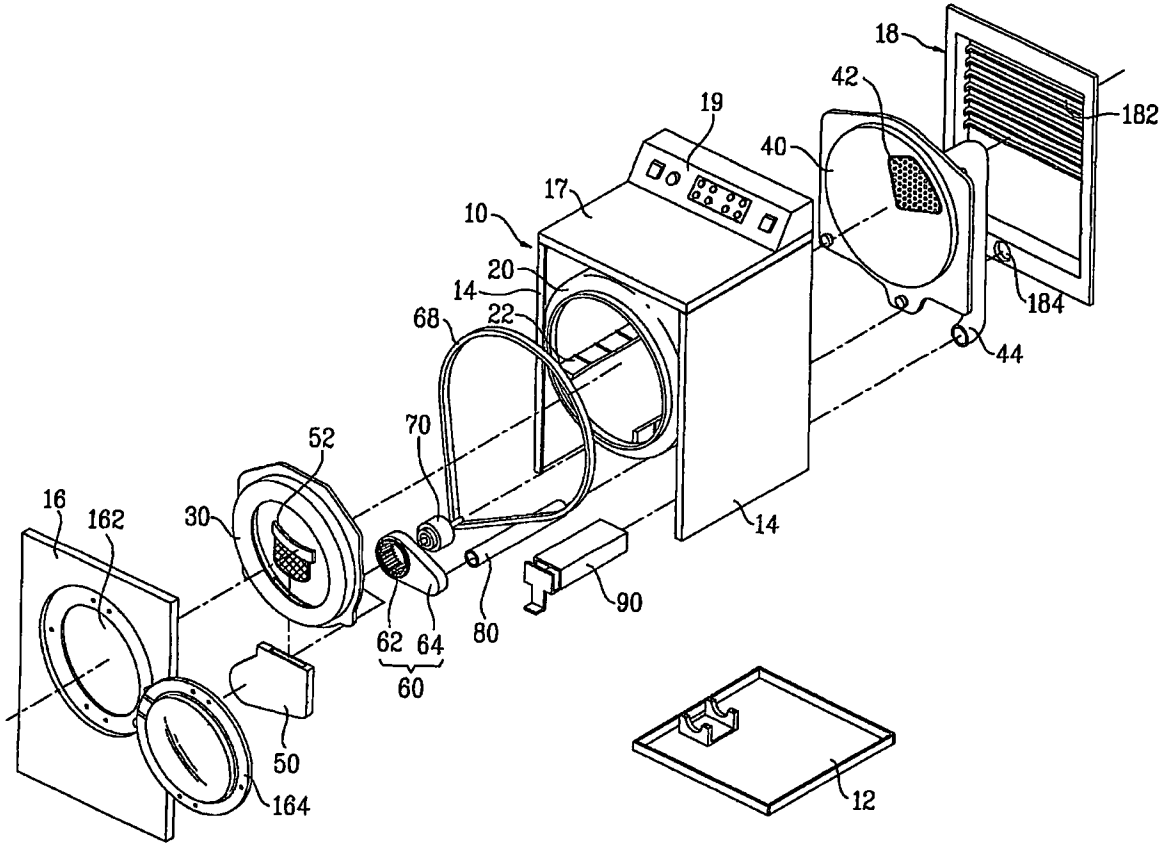
FIG. 1 is an exploded perspective view showing a laundry dryer in accordance with the present invention.

Reference will now be made in detail to the preferred embodiments of the present invention, examples of which are illustrated in the accompanying drawings. Wherever possible, the same reference numbers will be used throughout the drawings to refer to the same or like parts.

Hereinafter, a laundry dryer having a steam generator according to the present invention will be described with reference to FIGS. 1 and 2.

A rotating drum 20, and a motor 70 and a belt 68 for driving the drum 20 are mounted inside a cabinet 10 forming an cuter appearance of a laundry dryer. A heater 90 (which will be called a "hot air heater") for making high-temperature air (which will be called "hot air") by heating the air and a hot air supply duct 44 for supplying the hot air generated by the hot air heater 90 into the drum 20 are mounted to predetermined positions of the cabinet 10. An exhaust duct 80 for exhausting high-moisture air absorbing moisture from objects to be dried contained in the drum 20 and a blower unit 60 for sucking the high-moisture air are mounted in the cabinet 10. And, a steam generator 200 for generating high-temperature steam is mounted to a predetermined position of the cabinet 10. In this embodiment, an indirect drive type using the motor 70 and the belt 68 is adapted to rotate the drum 20, however, it is not restricted thereto. In other words, a direct drive type may also be adapted to the present invention, such that a motor is directly connected to a rear portion of the drum 20 to directly rotate the drum 20.

The aforesaid components will now be described in detail.

The cabinet 10 forming the cuter appearance of the laundry dryer includes a base 12 which forms a floor, a pair of side covers 14 which are vertically mounted to the base 12, a front cover 16 and a rear cover 18 which are respectively mounted to front ends and rear ends of the side covers 14, and a top cover 17 which is mounted to upper ends of the side covers 14. A control panel 19 provided with various operating switches is disposed at the top cover 17 or the front cover 16, and a door 164 is mounted to the front cover 16. The rear cover 18 is provided with an air inlet part 182 thrash which external air flows into the cabinet 10 and an exhaust hole 184 through which air in the drum 20 is exhausted outside.

The drum 20 functions as a drying chamber in which a drying operation is performed. Preferably, a lift 22 for lifting up and subsequently dropping the objects to be dried is mounted in the drum 20, thereby increasing the agitation of the objects to be dried and improving the drying performance.

A front supporter 30 and a rear supporter 40 are mounted between the drum 20 and the cabinet 10 (the front cover 16 and the rear cover 18). The drum 20 is rotatably mounted between the front supporter 30 and the rear supporter 40, and sealing members (not shown) are mounted between the front supporter 30 and the drum 20 and between the rear supporter 40 and the drum 20. That is, the front supporter 30 and the rear supporter 40 block the front portion and the rear portion of the drum 20 to form the drying chamber, and support the front end and the rear end of the drum 20.

The front supporter 30 is formed with an opening which communicates the drum 20 with the outside of the laundry dryer, and the opening is selectively opened and closed by the door 164. A lint duct 50, a passage through which the air in the drum 20 passes to be exhausted, is connected to the front supporter 30, and a lint filter 52 is mounted in the lint duct 50. One end of the blower unit 60 is connected to the lint duct 50, the other end of the blower unit 60 is connected to the exhaust duct 80, and the exhaust duct 80 communicates with the exhaust hole 184 provided at the rear cover 18. Accordingly, when the blower unit 60 operates, the air in the drum 20 is exhausted through the lint duct 50, the exhaust duct 80 and the exhaust hole 184. At this time, a foreign substance like fluff is filtered by the lint filter 52. The blower unit 60 includes a blower 62 and a blower housing 64, and the blower 62 is connected to the motor 70 for driving the drum 20 and driven by the motor 70.

A rear supporter 40 is formed with an opening 42 which has a plurality of throughholes, and the hot air supply duct 44 is connected to the opening 42. The hot air supply duct 44 communicates with the drum 20, so as to function as a passage for supplying the hot air into the drum 20. For this reason, the hot air heater 90 is maimed to the hot air supply duct 44.

Figure 3:
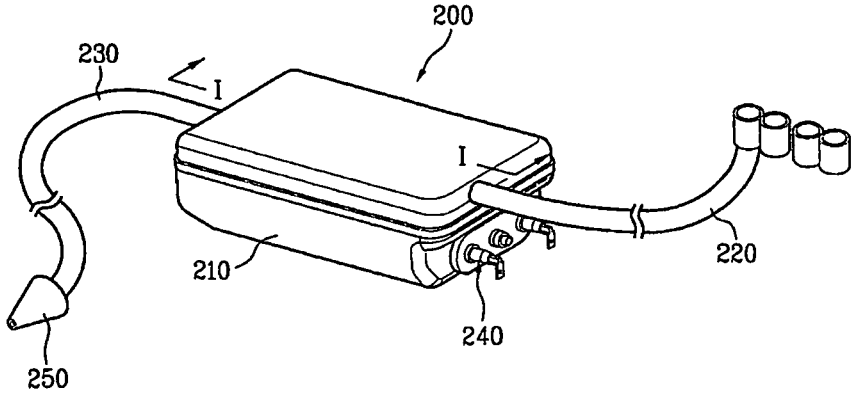
FIG. 3 is a perspective view showing a steam generator in FIG. 1.
Figure 4:
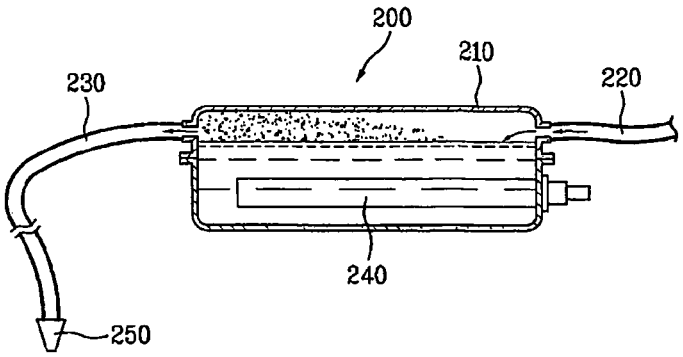
FIG. 4 is a sectional view taken along line I-I in FIG. 3.

Meanwhile, the steam generator 200 for generating the steam to supply the steam into the drum 20 is mounted to a predetermined position of the cabinet 10. Referring to FIGS. 3 and 4, the steam generator 200 will now be described in detail.

The steam generator 200 includes a steam generating part for making the steam, a water supply part which is connected to a water supply source at one end and connected to the steam generating part at the other end, and a steam supply part which is connected to the steam generating part at one end and supplies the steam into the drum through the other end. Preferably, the steam supply part is provided with a steam injection part at the other end to effectively inject the steam into the drum. The steam injection part has a function of efficiently injecting the steam into the drum with optimum injection angle and distribution. The steam injection part may be formed separately from the steam supply part or formed integrally with the steam supply part.

Also, although it is illustrated in FIGS. 3 and 4 that the water supply part is disposed at one side of the steam generating part and the steam supply part is disposed at the other side of the steam generating part, it is not restricted thereto. That is, the water supply part and the steam supply part may be disposed at the same side, or the mounting positions thereof may be adequately modified.

Referring to FIGS. 3 and 4, a particular embodiment of the steam generator will now be described in detail.

The steam generator 200 includes a water tank 210 in which water is stored, a heater 240 which is maimed in the water tank 210, a water supply hose 220 which is connected to one side of the water tank 210 to supply the water, and a steam hose 230 which is connected to the other side of the water tank 210 to discharge the steam. It is preferable to mount a nozzle 250 having a specific shape to a front end of the steam hose 230. One end of the water supply hose 220 is connected to the exterior water supply source like a faucet, and the front end of the steam hose 230 or the nozzle 250 is disposed at a predetermined position of the drum 20 to inject the steam into the drum 20.

As shown in FIGS. 3 and 4, the water tank 210 and the heater 240 correspond to the steam generating part, the water supply hose 220 corresponds to the water supply part, the steam hose 230 corresponds to the steam supply part, and the nozzle 250 corresponds to the steam injection part.

Figure 6:
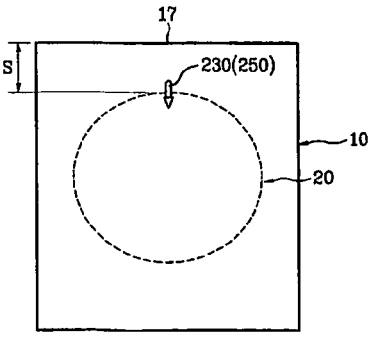
FIG. 6 is a front view schematically showing an exemplary mounting position of a steam supplying part of a steam generator.
Figure 7:
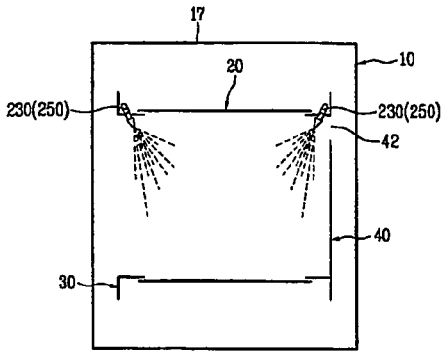
FIG. 7 is a schematic side view of FIG. 6.

Referring to FIGS. 1, 6 and 7, an exemplary mounting structure of the steam generator will now be described in detail.

It is preferable that the steam generator 200 is positioned over the drum 20, i.e., between the upper portion of the drum 20 and the top cover 17. Because a comparatively large space S is commonly provided between the drum 20 and the top cover 17 inside the cabinet 10, it is effective to mount the steam generator 200 in the space S between the drum 20 and the top cover 17 in terms of space utilization. Also, if mounting the steam generator 200 in the space S, when the steam generator 200 is alt of order, a repairman can easily repair or replace the steam generator 200 by only separating the top cover 17 from the cabinet 10, thereby facilitating the maintenance works.

The front end of the steam supply part 230 of the steam generator 200 should be positioned at least at front and rear ends of the drum 20. For this, it is preferable to form the steam generator 200 to have a plurality of front ends of the steam supply part 230. Although it is not illustrated in detail in the drawings, the steam generator 200 may be structured such that a plurality of steam supply parts 230 are branched off from the steam generating part 210, or a plurality of front ends are branched off from the steam supply part 230.

If structured as described above, it is possible to dampen the objects to be dried in the drum 20 more effectively. This is because the steam supplied into the drum 20 from both the front and rear ends of the drum 20 can rapidly dampen the objects to be dried in the drum 20. Also, if controlling the front ends of the steam supply part 230 positioned at the front and rear ends of the drum 20 respectively by use of valves (not shown), the injection angle and distribution of the steam injected into the drum 20 can be adjusted more precisely, and the objects to be dried can be dampened more effectively.

Also, it is more preferable to dispose only the front ends of the steam supply part 230 adjacently to the opening 42 of the drum 20, rather than to dispose the whole steam generator 200. Here, the front end of the steam supply part 230 means a member which actually supplies the steam into the drum 20. The front end of the steam supply part 230 may be a front end itself or the steam injection part like the nozzle 250.

It is preferable that the front ends of the steam supply part 230 are positioned at a middle of the drum 20 (see FIG. 6).

It is further preferable that the front ends of the steam supply part 230 are directed toward a center of the drum 20.

On the other hand, the front ends of the steam supply part 230 positioned at the front and rear ends of the drum 20 may be mounted to the drum 20 in all directions (up/down and left/right). For example, one of the front ends of the steam supply part 230 is disposed at the upper portion of the drum 20, and the other front end of the steam supply part 230 is disposed at the lower portion of the drum 20, so that the steam can be supplied into the drum 20 simultaneously from the upper and lower portions of the drum 20.

Figure 8:
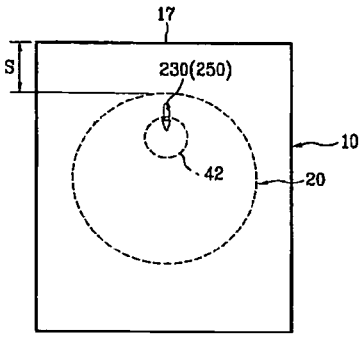
FIG. 8 is a front view schematically showing another exemplary mounting position of a steam supplying part of a steam generator.
Figure 9:
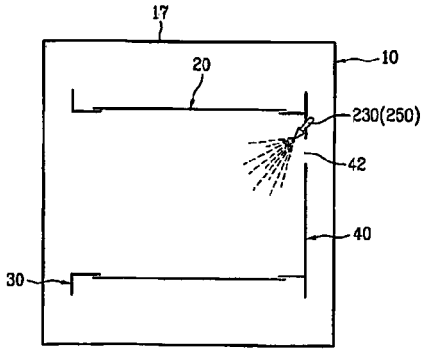
FIG. 9 is a schematic side view of FIG. 8.

Referring to FIGS. 1, 8 and 9, another exemplary, mounting structure of the steam generator will now be described in detail.

As described above, it is more preferable to dispose the steam generator 200 near the opening 42 of the drum 20. Because the opening 42 of the drum 20 functions as an inlet through which hot air is supplied into the drum 20, if the steam generator 200, especially the steam supply part 230, is disposed near the opening 42 of the drum 20, the steam can be injected into the drum 20 by the hot air supplied into the drum 20. Accordingly, the injection angle and distribution of the steam injected into the drum 20 can be adequately adjusted, and the objects to be dried can be dampened more effectively. For convenience of description, it has been explained that the steam injected into the drum 20 is mixed with the hot air passing through the opening 42. However, the steam may be mixed with unheated air (the detailed description thereof will be made later).

Also, it is more preferable to dispose only the front ends of the steam supply part 230 adjacently to the opening 42 of the drum 20, rather than to dispose the whole steam generator 200. Here, the front end of the steam supply part 230 means a member which actually supplies the steam into the drum 20. The front end of the steam supply part 230 may be a front end itself or the steam injection part like the nozzle 250.

It is preferable that the front ends of the steam supply part 230 are positioned at the middle of the drum 20 (see FIG. 8). It is further preferable that the front ends of the steam supply part 230 are directed toward both the opening 42 of the drum 20 and the center of the drum 20. And, the front ends of the steam supply part 230 positioned near the opening 42 of the drum 20 may be mounted in all directions (up/down and left/right) around the opening 42.

Figure 10:
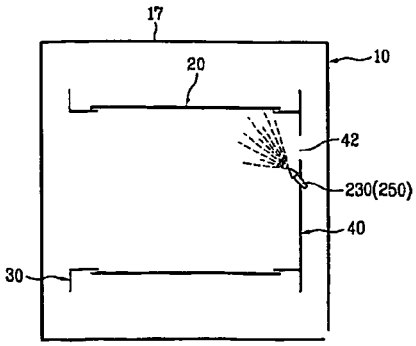
FIG. 10 is a front view schematically showing yet another exemplary mounting position of a steam supplying part of a steam generator.

It is illustrated in FIGS. 8 and 9 that the front end of the steam supply part 230 is slanted toward the opening 42 and directed toward the center of the drum 20, however, it is not restricted thereto. For example, as shown in FIG. 10, the front end of the steam supply part 230 may be disposed under the opening 42 of the drum 20. In this case, if slantedly mounting the opening 42 of the drum 20 toward the center of the drum 20, the front end of the steam supply part 230 can be directed toward both the opening 42 of the drum 20 and the center of the drum 20.

Although it is not illustrated in the drawings, the front ends may be branched off from the steam supply part 230 and a plurality of injection holes may be disposed at the opening 42 of the drum 20.

Also, as yet another exemplary embodiment which is constituted by combining the previous exemplary embodiments, the present invention may be structured such that the front ends of the steam supply part 230 are disposed at the front and rear ends of the drum 20 and at the same time the steam generator 200 is disposed adjacently to the opening 42 of the drum 20.

Figure 11:
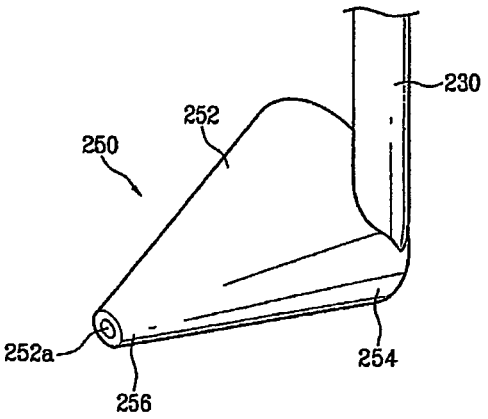
FIG. 11 is a perspective view showing essential elements of a steam generator.
Figure 12:
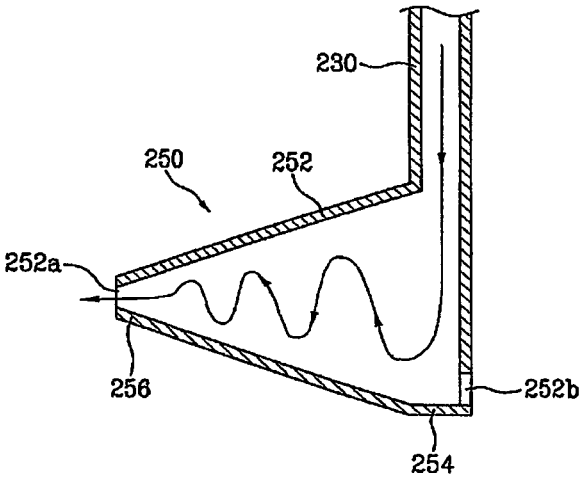
FIG. 12 is a longitudinal sectional view of FIG. 11.
Figure 13:
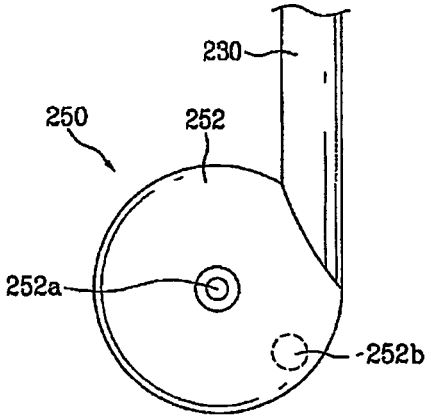
FIG. 13 is a front view of FIG. 11.

Referring to FIGS. 11 to 13, the steam injection part will now be described in detail.

A body 252 of the steam injection part 250 is formed in a divergent-convergent duct shape, preferably a conical shape. A front end of the body 252 of the steam injection part 250, i.e., a convergent portion 256 is formed with an injection hole 252*a*. A rear end of the body 252 of the steam injection part 250, i.e., a divergent portion 254 is connected to the steam supply part 230. At this time, it is preferable that the steam supply part 230 is connected to the divergent portion 254 of the steam injection part 250 in a tangential direction. This is for causing a vortex flow of the steam entering the body 252 of the steam injection part 250, thereby effectively injecting the steam into the drum 20.

The steam injection part 250 is formed with a discharge hole 252*b* through which condensed water is discharged. Preferably, the discharge hole 252*b* is formed at the divergent portion 254. This is because fine wrinkles are increasingly generated at the objects to be dried if liquid moisture is directly transferred to the objects to be dried. Accordingly, it is preferable to prevent the liquid moisture from being directly transferred to the objects to be dried. However, in actual practice, it is difficult to avoid the generation of the condensed water to some extent when the steam injection part 250 injects the steam.

Therefore, it is preferable to discharge the condensed water effectively so that the condensed water is not directly transferred to the objects to be dried. As structured like this embodiment, if the discharge hole 252*b* is formed at the steam injection part 250, because the condensed water is naturally discharged through the discharge hole 252*b*, the condensed water is effectively prevented from being directly transferred to the objects to be dried.

It is possible to adequately adjust the mounting angle of the steam injection part 250. And, in order to effectively discharge the condensed water thrash the discharge hole 252*b*, the discharge hole 252*b* of the steam injection part 250 is disposed at a position lower than the injection hole 252*a* of the steam injection part 250.

Hereinafter, an operation of the laundry dryer having the steam generator according to the present invention will be described.

The front end of the steam supply part 230 is disposed adjacently to the opening 42, a passage for the hot air, of the drum 20. Therefore, the steam injected into the drum 20 is mixed with the hot air, and transferred to the objects to be dried contained in the drum 20. As a result, it is possible to dampen the objects to be dried effectively and evenly.

On the other hand, the front end of the steam supply part 230 is positioned in the rear of the drum 20. Because the opening 42 of the drum 20 is typically positioned in the rear of the drum 20, the front end of the steam supply part 230 disposed near the opening 42 is positioned in the rear of the drum 20 in the course of nature. Such a structure also has an effect of preventing the condensed water generated at the front end of the steam supply part 230 from being directly transferred to the objects to be dried. According to experiments, it has been found that the condensed water deteriorates the drying and crease removal performances if the condensed water gets directly in touch with the objects to be dried. The present invention has features of preventing the condensed water from being transferred directly to the objects to be dried and effectively dampening the objects to be dried, thereby increasing, the drying and crease removal performance.

The front end of the steam supply part 230 of the steam generator 200 is positioned near the opening 42 of the drum 20, and the steam generating part is positioned at the side upper portion of the drum 20. This is because the space between the side upper portion of the drum 20 and the top cover 17 provides higher space utilization than the space between the middle upper portion of the drum 20 and the top cover 17.

Although the steam generator 200 is disclosed in this embodiment such that a certain quantity of water contained in the water tank 210 is heated by the heater 240 to generate the steam, the present invention is not restricted thereto. That is, any device capable of generating steam can be used as the steam generator in the present invention. For example, the present invention may be modified such that the water is not contained in a specific space and is heated by mounting the heater around the water supply hose thrash which the water flows.

Figure 2:
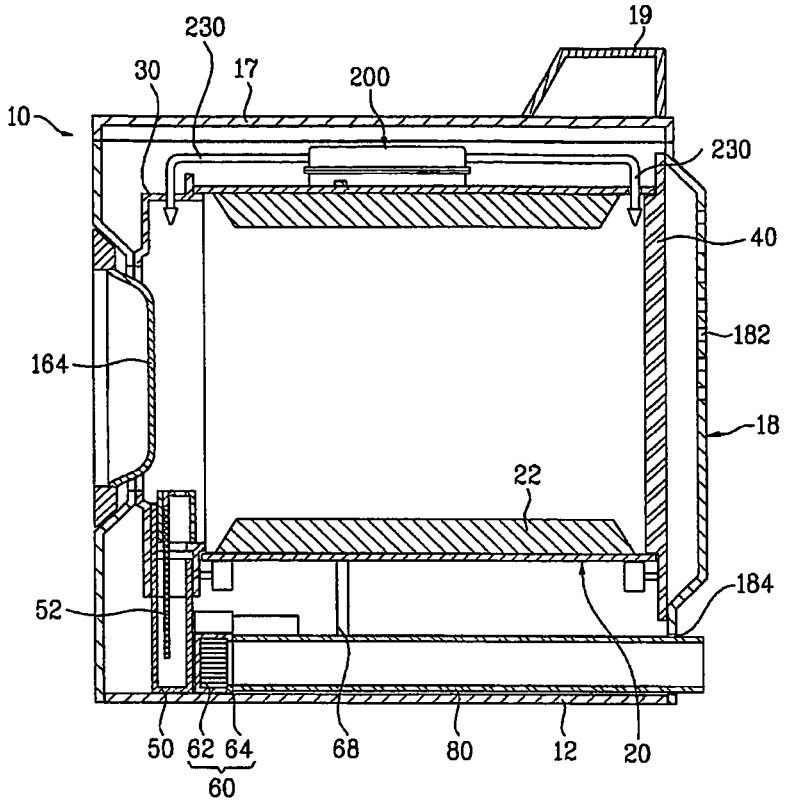
FIG. 2 is a longitudinal sectional view of FIG. 1.
Figure 5:
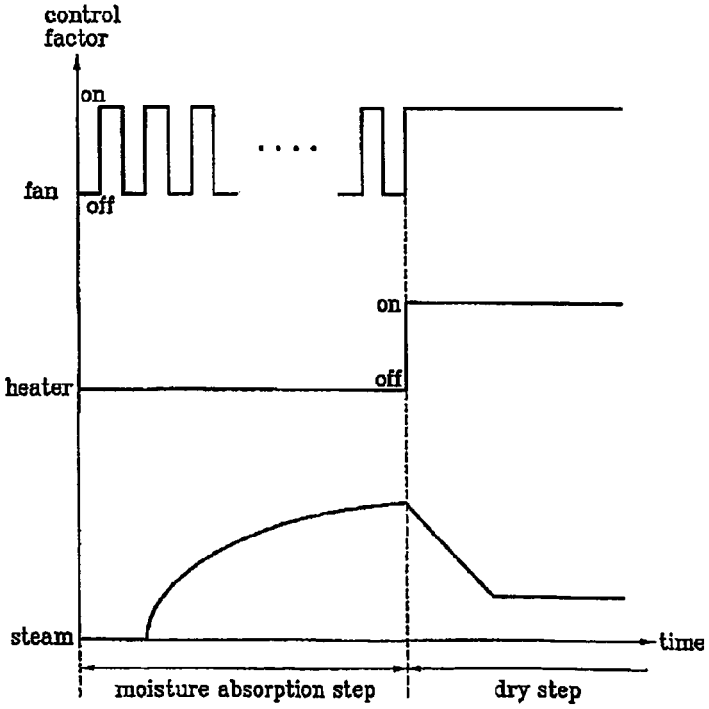
FIG. 5 is a graph showing relationships of control factors for controlling a laundry dryer in accordance with the present invention.

Referring to FIGS. 1, 2 and 5, the laundry dryer and the control method thereof will now be described.

The control method of the laundry dryer according to the present invention includes a dampening step and a drying step. The control method of the laundry dryer according to the present invention has a feature of performing the dampening step before the drying step, as compared to the convention control method. The dampening step means a step of percolating moisture into the objects to be dried to swell the same. The drying step can be performed by a process identical or similar to the conventional drying step.

The dampening step and the drying step will now be described in detail.

A user throws the objects to be dried, e.g., the dehydrated laundry into the drum 20, and manipulates the operation buttons to operate the laundry dryer. When the laundry dryer starts to operate, the dampening step is first performed. In the dampening step, the steam generator 200 is operated. Describing in detail, the heater 240 of the steam generator 200 is driven to heat the water and generate the steam, and the steam is injected into the drum 20. The steam is not generated immediately after the heater 240 starts to operate. After a certain time elapses, the steam is generated, and the amount of the generated steam is increased as the time elapses. When the objects to be dried absorb the moisture sufficiently, the operation of the steam generator 200 is stopped. An operating time of the dampening step varies according to a kind of objects to be dried, and can be adequately determined by experiments. This is because it has been found by experiments that a crease removal effect is generally increased as a moisture absorption or a water content of the objects to be dried is higher. However, there is a difference in a degree of absorbing the moisture at the same humidity according to a kind of cloth. For example, the moisture absorption of polyester is relatively low and the moisture absorption of cotton is relatively high at the same humidity.

Accordingly, it is preferable to control the dampening step by determining an optimum moisture absorption according to the kind of cloth and an operating time required to reach the optimum moisture absorption. In the dampening step, an operating method of the steam generator 200 is not limited to one type. The steam generator 200 can be adequately controlled so as to reach the determined moisture absorption by various operating methods. For example, the steam generator 200 may be controlled such that the steam generator 200 starts to operate at the initiation of the dampening step and stops operating at the termination of the dampening step. Alternatively, the steam generator 200 may be controlled to operate intermittently. Alternatively, the optimum moisture absorption according to the kind of cloth may be determined by experiments and a humidity sensor may be mounted to the drum 20, so that when it is determined that the objects to be dried absorb the moisture to the determined moisture absorption based on a signal from the humidity sensor, the steam generator 200 is controlled to stop operating to terminate the dampening step.

On the other hand, in the dampening step, it is preferable to agitate the objects to be dried. If the objects to be dried are agitated, the objects to be dried can evenly absorb the moisture. A method of agitating the objects to be dried is not limited to one type. It is most preferable to adequately rotate the drum 20. In this case, rotating conditions of the drum 20, such as a RPM (Revolution Per Minute), a rotating direction and the like, are not specifically restricted, and can be adequately determined. For example, it is preferable to repeatedly rotate the drum 20 in a forward direction and a reverse direction. It is more preferable to intermittently rotate the drum 20.

It is preferable not to operate the hot air heater 90 in the dampening step, but to operate the hot air heater 90 at initiating the drying step after the termination of the dampening step. If the hot air heater 90 is not operated in the dampening step, the steam emitted from the front end of the steam supply part 230 is mixed with unheated air. On the other hand, if the hot air heater 90 is operated in the dampening step, the steam is mixed with hot air.

In the dampening step, it is preferable to operate the blower 62, more preferably to intermittently operate. A portion of the steam injected into the drum 20 may be condensed in the dampening step, and the blower 62 can discharge the condensed water or the high-moisture air just before being, condensed out of the drum 20. According to the experimental results, when liquid moisture, not in a steam state, is absorbed in the objects to be dried, the fine wrinkles are increased. Accordingly, it is preferable to discharge the condensed water of a liquid type so as not to be directly absorbed in the objects to be dried. To operate the blower 62 in the dampening step may be adequate for a condenser-type dryer, especially.

Also, as shown in FIGS. 7 and 9, since the front end of the steam supply part 230 is disposed adjacently to the opening 42 of the drum 20, the condensed water is prevented from getting directly in touch with the objects to be dried, and it is possible to effectively dampen the objects to be dried. As a result, the drying and crease removal effects are increased. And, the steam is effectively injected into the drum 20, thereby preventing the creases from being generated at the objects so as to be dried more effectively.

As shown in FIG. 12, since the vortex flow of the steam is formed in the steam injection part 250 and injected into the drum 20, and the condensed water is discharged through the discharge hole 252*b* of the steam injection part 250, the generation of the creases at the objects to be dried can be prevented more effectively.

Next, the drying step will now be described. In the drying step, the hot air heater 90 and the blower 62 are operated to supply the hot air into the drum 20, and the hot air heat-exchanges with the objects to be dried in the drum 20 to dry cut the objects to be dried. It is preferable to stop the operation of the steam generator 200 in the drying step. Since the control method of the laundry dryer in the drying step can be performed identically to the conventional control method, the detailed description thereof will be omitted.

According to the experimental results, there is a difference according to a kind of the objects to be dried, e.g., a kind of cloth, and a moisture absorbing degree, however, if the dampening step is performed before the drying step, the crease removal and prevention effect is securely increased.

In the above description, the dehydrated laundry in the washing machine has been referred as an example of the objects to be dried, however, it is not restricted thereto. The laundry dryer of the present invention can also remove the creases from the clothes which are worn for about a day or have been kept in the custody in a creased state for a relatively long time, i.e., the clothes which have been already dried out and have a few creases. In other words, the laundry dryer of the present invention can be used as a kind of crease removing device.

INDUSTRIAL APPLICABILITY

As apparent from the above description, the laundry dryer having the steam generator according to the present invention has the following industrial advantages.

Firstly, the generation of creases at the dried objects can be prevented and the creases can be removed effectively. Also, the creases or the wrinkles of the clothes in the dried state can be effectively removed without ironing.

Secondly, since the front ends of the steam generator or the steam supply part are positioned at the front and rear ends of the drum and/or positioned adjacently to the opening of the drum, it is possible to effectively dampen the objects to be dried, and the condensed water is prevented from getting directly in touch with the objects to be dried. As a result, the drying and crease removal performances are increased.

Thirdly, since the vortex flow of the steam is formed in the steam injection part of the steam generator and injected into the drum, and the condensed water is discharged through the discharge hole of the steam injection part, the generation of the creases at the objects to be dried can be prevented more effectively.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

The invention claimed is:

1. A laundry dryer comprising:

a door;

a drum which contains objects to be dried;

a heater which makes high-temperature air by heating the air;

a hot air supply duct which supplies the hot air generated by the heater or unheated air into the drum;

a blower which sucks air inside the drum;

a front supporter formed with a first opening which communicates the drum with the outside of the laundry dryer, the first opening being selectively opened and closed by the door;

a rear supporter formed with a second opening which has a plurality of through holes, the hot air supply duct being connected to the second opening through which the hot air or the unheated air is supplied into the drum and the drum being rotatably mounted between the front supporter and the rear supporter; and a steam generator including:

a steam generating part which makes steam;

a plurality of steam supply parts which are connected to the steam generating part; and a plurality of steam injection parts, one provided at a front end of each of the steam supply parts to inject the steam directly into the drum, wherein one steam injection part is positioned adjacent to the second opening, inside the drum and at a rear end of the drum so that the steam is directly injected into the drum, wherein another steam injection part is positioned adjacent the first opening, inside the drum and at a front end of the drum, and wherein each steam injection part is directed toward the nearest opening.

2. The laundry dryer according to claim 1, wherein the one steam injection part is formed in a divergent-convergent duct shape, wherein the steam supply part is tangentially connected to the one steam injection part, perpendicular to the one steam injection direction, wherein the steam is injected from the convergent portion of the one steam injection part, wherein the one steam injection part further includes a discharge hole, in the divergent portion, to discharge water which condenses from steam within the one steam injection part.

3. The laundry dryer according to claim 2, wherein the one steam injection part is positioned at an horizontally upper portion of the drum.

4. The laundry dryer according to claim 2, wherein the one steam injection part is positioned at a horizontally middle portion of the drum.

5. The laundry dryer according to claim 2, wherein the front end of the one steam injection part is disposed to be directed toward a center of the drum.

6. The laundry dryer according to 2, wherein the steam generating part is positioned at the front end of the drum.

7. The laundry dryer according to claim 2, wherein the one steam injection part is positioned at a horizontally middle of the drum, and the steam generating part is positioned at a side of the drum.

8. The laundry dryer according to claim 2, wherein the steam generating part is positioned at an upper portion of the drum.

9. The laundry dryer according to claim 8, wherein the steam generating part is positioned at a side of the drum.

10. The laundry dryer according to claim 2, wherein the steam supply part is connected to the divergent portion of the one steam injection part.

11. The laundry dryer according to claim 10, wherein the steam supply part is tangentially connected to the divergent portion of the one steam injection part.

12. The laundry dryer according to claim 2, wherein the divergent-convergent duct shape steam injection part has a conical shape.

13. The laundry dryer according to claim 12, wherein the one steam injection part has a divergent portion which is formed with a discharge hole through which condensed water is discharged.

14. The laundry dryer according to claim 13, wherein the one steam injection part has an injection hole, and wherein the discharge hole is disposed at a position lower than the injection hole.

15. The laundry dryer according to claim 2, wherein the one steam generator supplies the steam to the objects to be dried contained in the drum in a hot air non-supply state.

16. A method of controlling a laundry dryer, the laundry dryer including a door;

a drum which contains objects to be dried;

a heater which makes high-temperature air by heating the air;

a hot air supply duct which supplies the hot air generated by the heater or unheated air into the drum;

a blower which sucks air inside the drum;

a front supporter formed with a first opening which communicates the drum with the outside of the laundry dryer, the first opening being selectively opened and closed by the door;

a rear supporter formed with a second opening which has a plurality of through holes, the hot air supply duct being connected to the second opening through which the hot air or the unheated air is supplied into the drum and the drum being rotatably mounted between the front supporter and the rear supporter; and a steam generator including:

a steam generating part which makes steam;

a plurality of steam supply parts which are connected to the steam generating part; and a plurality of steam injection parts, one provided at a front end of each of the steam supply parts to inject the steam directly into the drum, wherein one steam injection part is positioned adjacent to the second opening, inside the drum and at a rear end of the drum so that the steam is directly injected into the drum, wherein another steam injection part is positioned adjacent the first opening, inside the drum and at a front end of the drum, and wherein each steam injection part is directed toward the nearest opening, the method comprising:

dampening the objects to be dried so that the objects to be dried have a predetermined moisture absorption by supplying the steam, wherein the dampening step includes, agitating the objects to be dried and operating the blower intermittently to discharge condensed water or high-moisture air out of the drum; and drying the objects to be dried which have absorbed moisture by operating the heater and the blower to supply the hot air into the drum.

17. The method according to claim 16, wherein the objects to be dried are agitated intermittently.

18. The method according to claim 16, wherein the dampening step includes:

dampening the objects to be dried in a hot air non-supply state.

* * * * *